US011175036B2

(12) United States Patent
Kim et al.

(10) Patent No.: US 11,175,036 B2
(45) Date of Patent: Nov. 16, 2021

(54) PYROLYSIS GASIFICATION APPARATUS FOR SOLID REFUSE FUEL

(71) Applicant: KOREA INSTITUTE OF ENERGY RESEARCH, Daejeon (KR)

(72) Inventors: Jeong Geun Kim, Daejeon (KR); Chong Pyo Cho, Daejeon (KR); Seong Ryong Park, Daejeon (KR)

(73) Assignee: Korea Institute of Energy Research, Daejeon (KR)

( * ) Notice: Subject to any disclaimer, the term of this patent is extended or adjusted under 35 U.S.C. 154(b) by 137 days.

(21) Appl. No.: 16/834,098

(22) Filed: Mar. 30, 2020

(65) Prior Publication Data

US 2021/0140633 A1 May 13, 2021

(30) Foreign Application Priority Data

Nov. 7, 2019 (KR) ..... 10-2019-0141418

(51) Int. Cl.
*F23G 5/027* (2006.01)
*F23G 5/44* (2006.01)
*F23G 5/033* (2006.01)

(52) U.S. Cl.
CPC ..... *F23G 5/0276* (2013.01); *F23G 5/033* (2013.01); *F23G 5/444* (2013.01); *F23G 2201/303* (2013.01); *F23G 2205/121* (2013.01)

(58) Field of Classification Search
CPC ..... F23G 2205/121; C10J 3/007; C10J 2300/1246
See application file for complete search history.

(56) References Cited

U.S. PATENT DOCUMENTS 2,332,781 A * 10/1943 Cohen ..... C10J 3/00 48/204
5,297,957 A * 3/1994 Brashears ..... F23G 5/20 432/105
6,084,147 A * 7/2000 Mason ..... G21F 9/32 588/19
2004/0060236 A1* 4/2004 Yoshikawa ..... B01J 12/005 48/63
2007/0204512 A1* 9/2007 Self ..... C10J 3/66 48/197 FM (Continued)

FOREIGN PATENT DOCUMENTS

KR 10-1008296 B1 1/2011

*Primary Examiner* — David J Laux
(74) *Attorney, Agent, or Firm* — Rabin & Berdo, P.C.

(57) ABSTRACT

Provided is a pyrolysis gasification apparatus for solid refuse fuel. The apparatus includes: a superheated steam housing formed in a cylindrical shape and installed in a horizontal direction, in which superheated steam is injected into the superheated steam housing; a screw casing formed in a tubular shape extending from one end to the other end inside the superheated steam housing and installed in the horizontal direction inside the superheated steam housing, in which solid refuse fuel (SRF) is introduced into the screw casing; a conveying screw with a plurality of screw blades on an outer peripheral surface, the conveying screw being installed inside the screw casing in the horizontal direction and rotating to convey the solid refuse fuel; and a superheated steam supplier for supplying superheated steam into the superheated steam housing, in which the superheated steam may move through a movement pat.

18 Claims, 9 Drawing Sheets

(56) References Cited

U.S. PATENT DOCUMENTS

| | | | | |
|---|---|---|---|---|
| 2009/0000194 | A1* | 1/2009 | Fan | C10J 3/482 48/199 R |
| 2011/0107670 | A1* | 5/2011 | Galley | C10J 3/57 48/197 R |
| 2016/0045946 | A1* | 2/2016 | Chyou | B09B 5/00 165/10 |

* cited by examiner

PYROLYSIS GASIFICATION APPARATUS FOR SOLID REFUSE FUEL

CROSS-REFERENCE TO RELATED APPLICATION

This application claims priority from Korean Patent Application No. 10-2019-0141418 filed on Nov. 7, 2019 in the Korean Intellectual Property Office, and all the benefits accruing therefrom under 35 U.S.C. 119, the contents of which in their entirety are herein incorporated by reference.

BACKGROUND

1. Technical Field

The present disclosure relates to a pyrolysis gasification apparatus for solid refuse fuel, and more specifically, to a pyrolysis gasification apparatus for solid refuse fuel that uses superheated steam to pyrolysis gasify solid refuse fuel more economically and efficiently.

2. Description of the Related Art

As society shows full-scale industrialization, refuse due to "mass production and mass consumption" is increasing rapidly. Meanwhile, the problem of environmental pollution accompanying refuse disposal is seriously raised. Therefore, efficient refuse disposal methods are urgently needed.

Generally, the refuse disposal methods include "reduction," "recycling," "regeneration," "landfill," or "incineration." Recently, a technology for pyrolyzing refuse in a high temperature and vacuum environment has been proposed.

Among the refuse disposal technologies using pyrolysis, a pyrolysis treatment technology is being developed, in which solid refuse fuel compressed into a pellet format from refuse plastics produced at work or at home, may be used as fuel, and the solid refuse fuel (SRF) may be pyrolyzed to obtain heat, thereby enabling to use it for a boiler or cogeneration.

The solid refuse fuel, i.e., SRF, stands for "Solid Refuse Fuel." It is a refuse solid fuel that is selected and smashed and dried only on combustible refuse such as plastic refuse to replace fossil fuel such as coal. It is higher in calories and cheaper than anthracite, making it a good resource for alternative fuels and heating for industrial and public institutions.

Currently, a technology for pyrolysis gasification apparatus using solid refuse fuel (SRF) is difficult to commercialize in Korea. This is because, as shown in the prior art Korean Patent No. 10-1008296, refuse solid fuel is pyrolyzed by a high temperature of 450° C. or higher generated by an electric heater in an extrusion screw, and in this case, it is economically inefficient to provide a high temperature environment of 400~500° C. for a large-scale pyrolysis device such as 10 ton or 20 ton by using the electric heater.

For means for heating solid refuse fuel in place of conventional electric heaters, research has been conducted to provide heat by injecting exhaust gas into a pyrolysis apparatus. However, the exhaust gas has a problem in that it causes corrosion to the pyrolysis device causing defects.

As such, the development of a technology for pyrolysis gasification technology is required, in which when thermal energy is obtained by pyrolyzing solid refuse fuel (SRF) using a pyrolysis gasification apparatus, the economics may be increased to enable commercialization of the pyrolysis gasification apparatus and the thermal efficiency may be improved.

PRIOR ART

Patent Document (Patent Document 1) Korean Patent No. 10-1008296

SUMMARY

The present disclosure has been conceived to solve the problems as described above. A pyrolysis gasification apparatus of solid refuse fuel according to the present disclosure is intended to achieve the commercialization of a pyrolysis gasification apparatus by pyrolysis gasification of the solid refuse fuel using superheated steam rather than an electric heater.

In addition, the present disclosure is intended to provide an indirect heating means inside the pyrolysis gasification apparatus to maintain the temperature inside the apparatus efficiently and to increase the overall thermal efficiency.

Further, the present disclosure is intended to be able to more efficiently preheat, pyrolyze, and separate the solid refuse fuel fed to the pyrolysis gasification apparatus and conveyed.

According to an aspect of the present disclosure, it includes: a superheated steam housing formed in a cylindrical shape and installed in a horizontal direction, in which superheated steam is injected into the superheated steam housing; a screw casing formed in a tubular shape extending from one end to the other end inside the superheated steam housing and installed in the horizontal direction inside the superheated steam housing, in which solid refuse fuel (SRF) is introduced into the screw casing; a conveying screw with a plurality of screw blades on an outer peripheral surface, the conveying screw being installed inside the screw casing in the horizontal direction and rotating to convey the solid refuse fuel; and a superheated steam supplier for supplying superheated steam into the superheated steam housing, in which the superheated steam may move through a movement path formed between an inside of the superheated steam housing and an outside of the screw casing to pyrolyze the solid refuse fuel.

In an embodiment, a plurality of heat accumulators may be inserted into the movement path.

In an embodiment, the heat accumulator may be in the form of a bead of a material having excellent heat transfer and durability, such as ceramic or steel, and may have a diameter of 10 to 30 mm.

In an embodiment, an inside of the conveying screw may have a form penetrated in a longitudinal direction, and the superheated steam may move through a through passage formed in the inside of the conveying screw.

In an embodiment, a plurality of heat accumulators may be inserted into the through passage of the conveying screw.

In an embodiment, the conveying screw may be made in a pair, and a pair of conveying screws may be provided to be adjacent to and parallel to each other, and the screw casing is in the form of a tubular shape coupled by welding a pair of hollow pipes having open sides to face each other, thereby being formed to surround an outer side of the pair of conveying screws.

In an embodiment, the pair of conveying screws may be rotated in opposite directions to each other, and is rotated to face inward adjacent to each other.

In an embodiment, a lower portion and an upper portion of the screw casing may be provided with a casing support for supporting the pair of hollow pipes with the open sides.

In an embodiment, a cross section of the casing support may be in the form of a support plate in a longitudinal direction having a "A" shape, and a plurality of holes may be formed on both sides thereof in the longitudinal direction, in which the superheated steam may move through the plurality of holes.

In an embodiment, a plurality of heat accumulators may be inserted into a space formed outside the screw casing and inside the casing support.

In an embodiment, a conveying direction of the superheated steam and the solid refuse fuel may be opposite to each other.

In an embodiment, both sides of the screw blades of the conveying screw may be any one of a spatula shape, a spiral shape, a semicircular shape, a conical shape, and an elliptical shape.

In an embodiment, an outlet side of the superheated steam housing may be provided with a heating device, thereby maintaining a high temperature in the superheated steam housing.

In an embodiment, the conveying screw may be divided into a conveying section A, a compression section B, and a pyrolysis section C, in which it may be configured so that a pitch spacing of the screw blades of the conveying screw for each divided section differs from each other.

In an embodiment, the pitch spacing of the screw blades of the compression section B of the conveying screw may be formed the smallest.

In an embodiment, the pitch spacings of the screw blades of the conveying section A and the pyrolysis section C of the conveying screw may be formed the same or the pyrolysis section C may be formed larger than the conveying section A.

In an embodiment, the movement path through which the superheated steam moves is divided into a first section, a second section, and a third section, in which the superheated steam having a different temperature may be individually supplied to each divided section.

In an embodiment, a temperature of the superheated steam supplied to each section may be controlled by adjusting a flow rate of the superheated steam depending on a reaction temperature of pyrolysis of the solid refuse fuel.

The pyrolysis gasification apparatus of the solid refuse fuel excludes conventional electric heaters and pyrolyzes the solid refuse fuel through injection of the superheated steam, thereby enabling to improve the economics of the pyrolysis gasification apparatus. Further, the fuel capacity may be increased by adjusting the flow rate of the superheated steam, and a temperature setting may be easily and efficiently controlled.

Further, the plurality of heat accumulators are provided inside the pyrolysis gasification apparatus, and the plurality of heat accumulators are heated by the superheated steam injected. Therefore, the high temperature in the pyrolysis gasification apparatus may be maintained with low temperature deviations through the heated plurality of heat accumulators, and simultaneously, indirect heating of the solid refuse fuel may increase the overall thermal efficiency of the apparatus.

Further, the heating device is provided on the outlet side of the superheated steam housing to prevent vaporized fuel obtained through the pyrolysis of the solid refuse fuel from cooling and oiling. Therefore, it may increase the yield of the vaporized fuel and reduce the amount of residues discharged.

Further, the conveying screw for conveying the solid refuse fuel is divided into the conveying, compression, and pyrolysis sections, and is provided with a variable type so that the pitch spacing of the screw blades is different for each section. Therefore, the solid refuse fuel conveyed by the conveying screw may be preheated, pyrolyzed, and separated more efficiently.

In addition, the movement path through which the superheated steam moves is divided into a plurality of sections, and the superheated steam having a different temperature is separately supplied to each section. Therefore, the solid refuse fuels may be pyrolyzed and vaporized more effectively.

Furthermore, high efficiency pyrolysis gasification of the solid refuse fuel may increase the yield of the vaporized fuel and reduce the emission of the residue. Therefore, it is also possible to reduce environmental problems due to the disposal of the solid refuse.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION OF THE EMBODIMENTS

Figure 1:
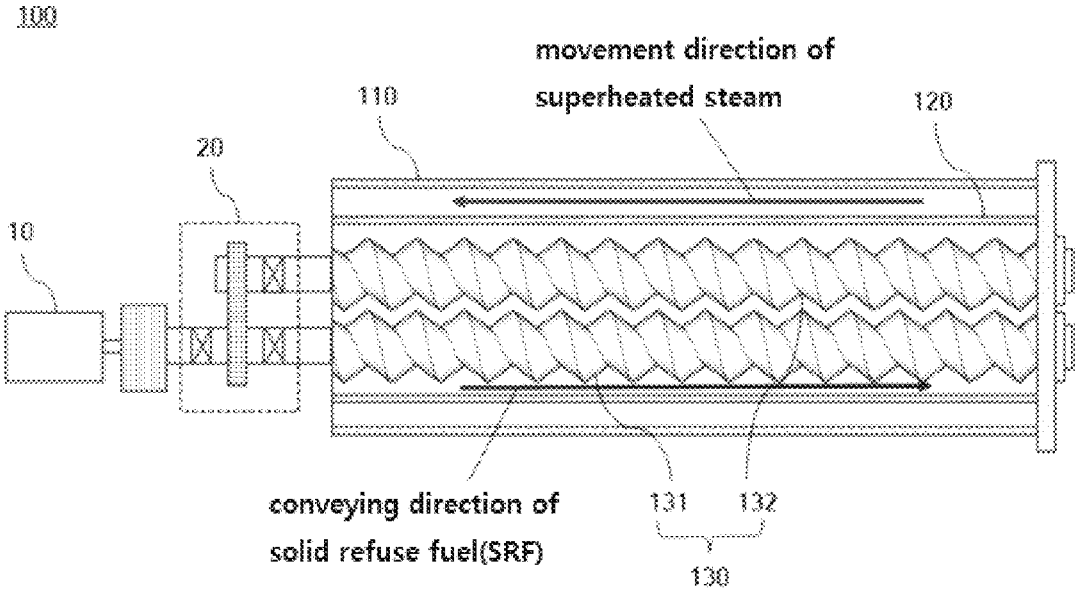
FIG. 1 is a view for explaining a pyrolysis gasification apparatus for solid refuse fuel according to a first embodiment of the present disclosure.

The present disclosure may add various transformations and may have various embodiments. Therefore, specific embodiments will be illustrated in the drawings and described in detail in the detailed description. However, this is not intended to limit the invention to specific embodiments. It is to be understood that all transformations, equivalents, and substitutes included in the spirit and scope of the present disclosure are included. In describing the present disclosure, when it is determined that the detailed description of the related known technology may obscure the subject matter of the present disclosure, the detailed description thereof will be omitted.

Terms such as first or second may be used to describe various components, but the components should not be limited by the terms. The terms are used only for the purpose of distinguishing one component from another.

The terminology used herein is for the purpose of describing specific embodiments only and is not intended to be limiting of the present disclosure. Singular expressions include plural expressions unless the context clearly dictates otherwise. Herein, the terms such as "comprise" or "have" are intended to specify the presence of stated features, integers, steps, operations, components, parts, or combinations thereof. It should be understood that they do not preclude the possibility of presence or addition of one or more other features, numbers, steps, operations, components, parts, or combinations thereof. Hereinafter, embodiments of the present disclosure will be described in detail with reference to the accompanying drawings.

Figure 2:
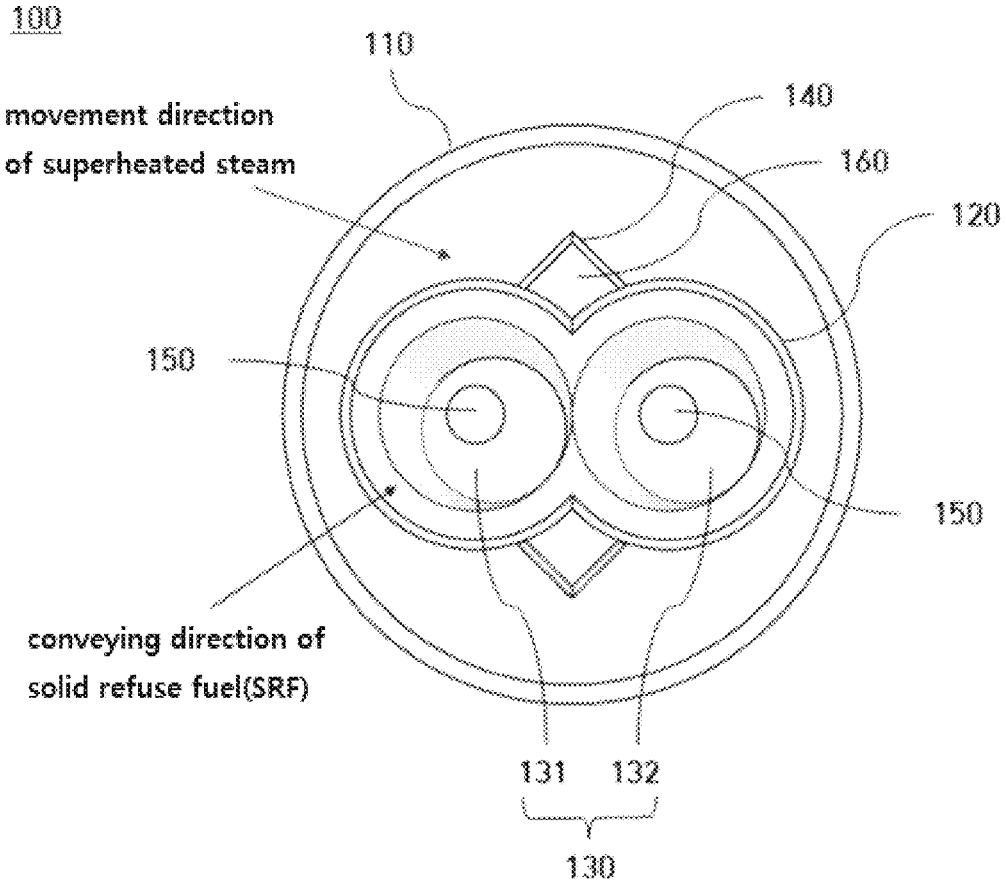
FIG. 2 is a cross-sectional view of the pyrolysis gasification apparatus for the solid refuse fuel according to the first embodiment of the present disclosure.
Figure 3:
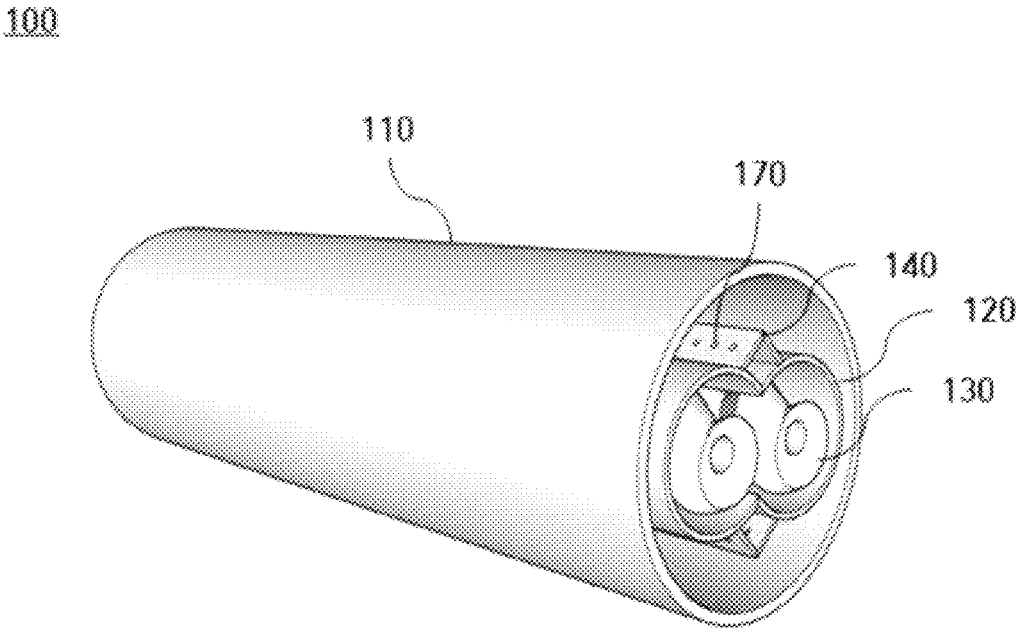
FIG. 3 is a perspective view of the pyrolysis gasification apparatus for the solid refuse fuel according to the first embodiment of the present disclosure.
Figure 4:
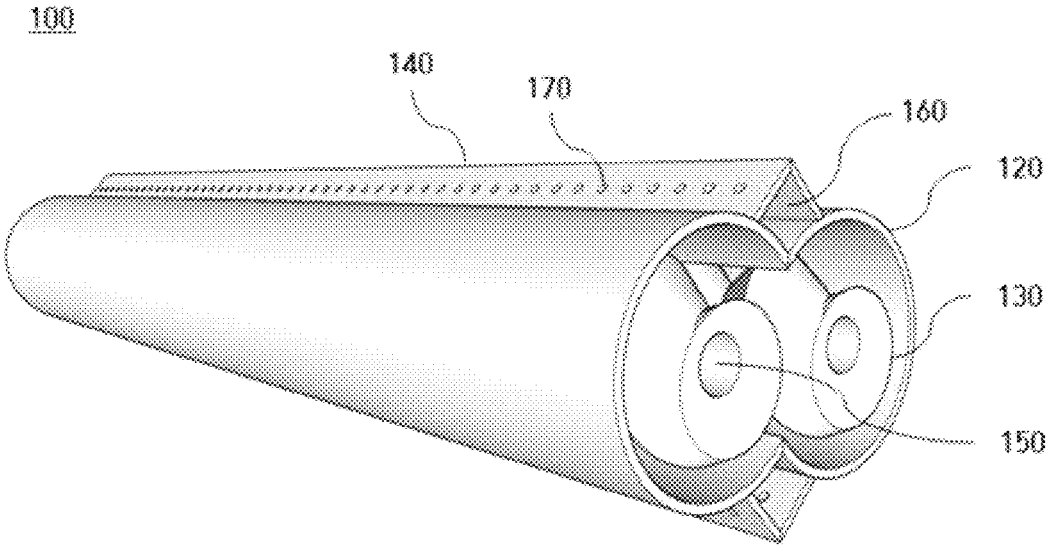
FIG. 4 is a perspective view showing an internal configuration of the pyrolysis gasification apparatus for the solid refuse fuel according to the first embodiment of the present disclosure.
Figure 5:
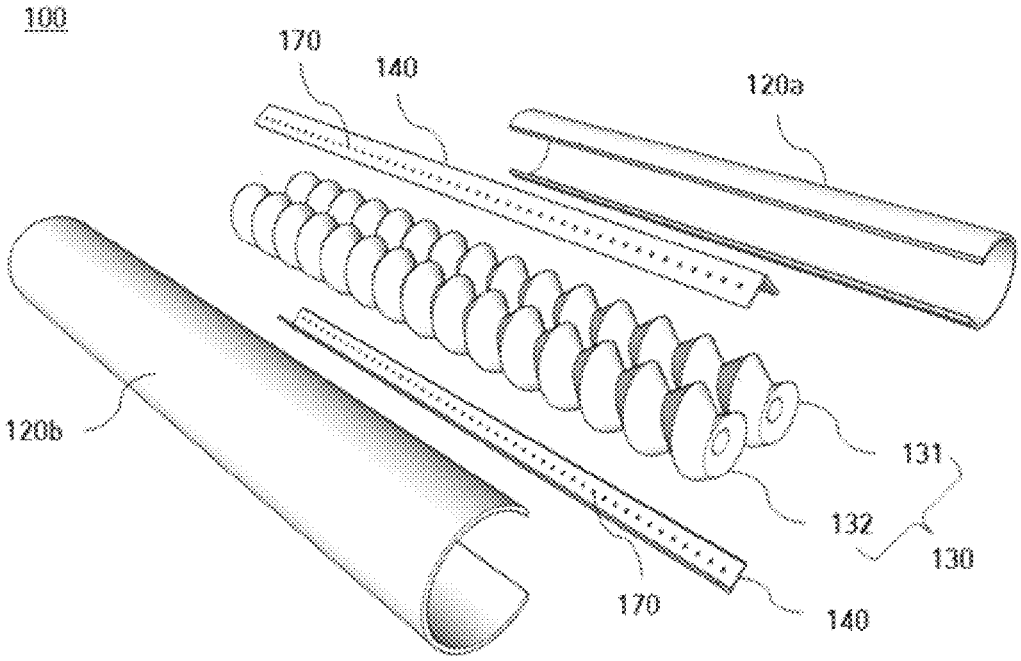
FIG. 5 is an exploded perspective view showing the internal configuration of the pyrolysis gasification apparatus for the solid refuse fuel according to the first embodiment of the present disclosure.
Figure 6:
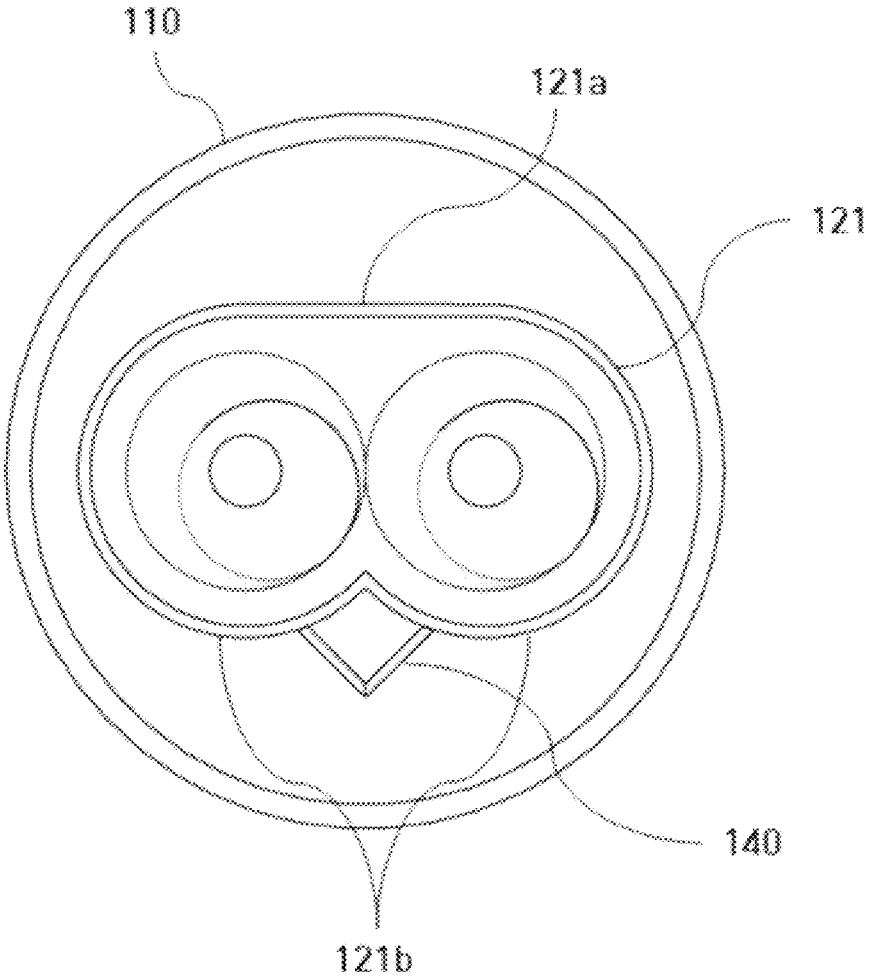
FIG. 6 is a sectional view of the pyrolysis gasification apparatus for the solid refuse fuel, in which it shows another embodiment of a screw casing in the pyrolysis gasification apparatus of the solid refuse fuel of the present disclosure.
Figure 7:
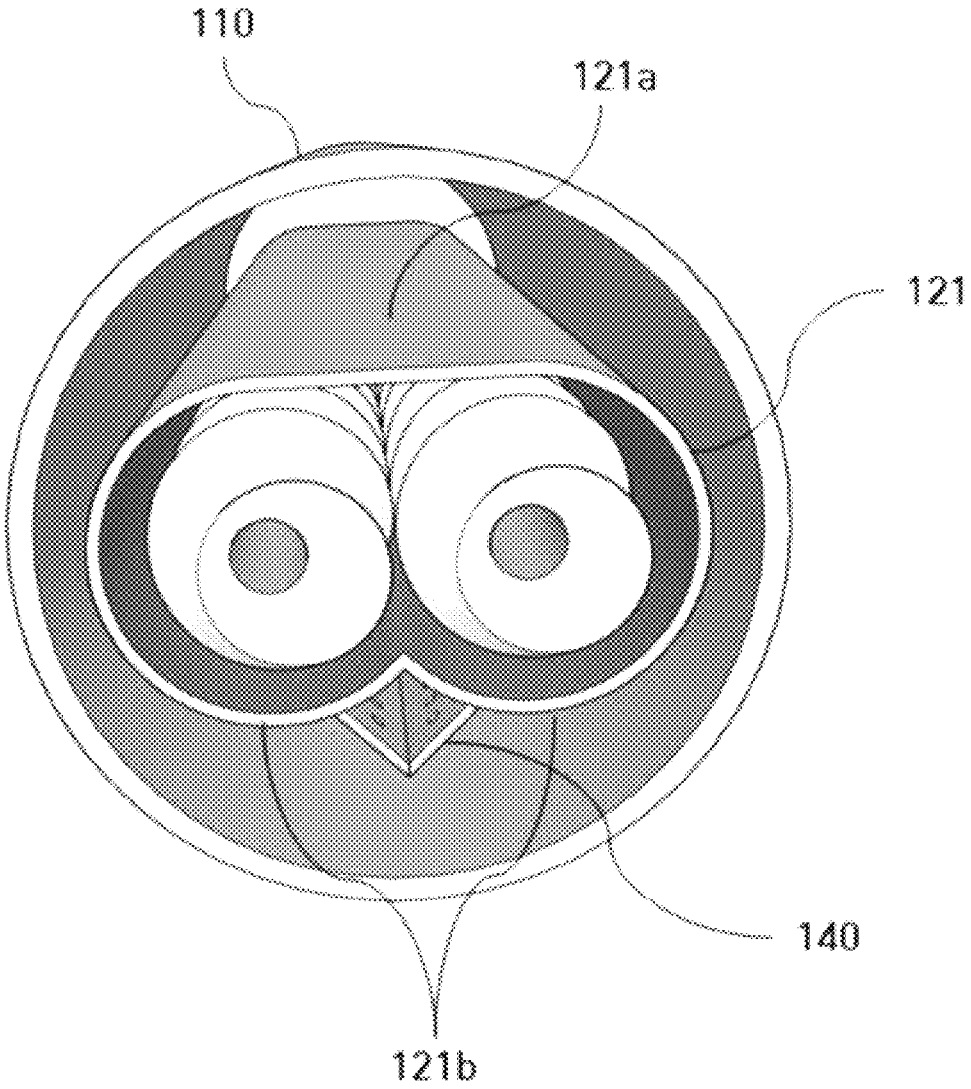
FIG. 7 is a perspective view of the pyrolysis gasification apparatus for the solid refuse fuel, in which it shows another embodiment of a screw casing in the pyrolysis gasification apparatus of the solid refuse fuel of the present disclosure.
Figure 8:
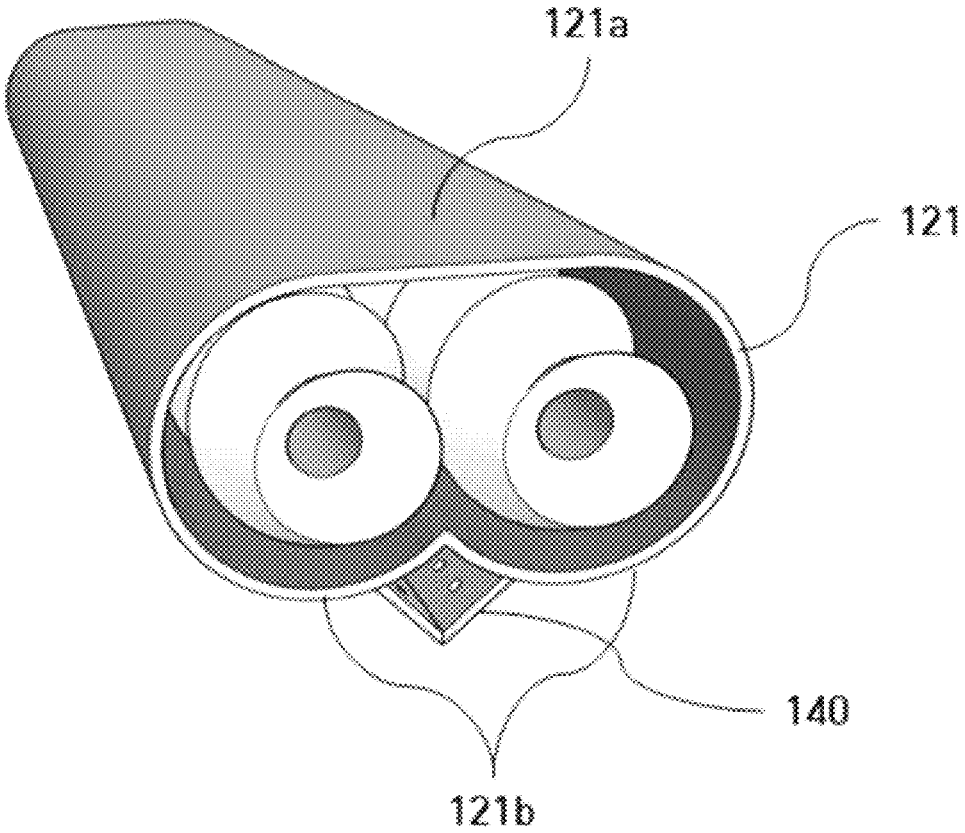
FIG. 8 is a perspective view showing a screw casing according to another embodiment of the present disclosure.
Figure 9:
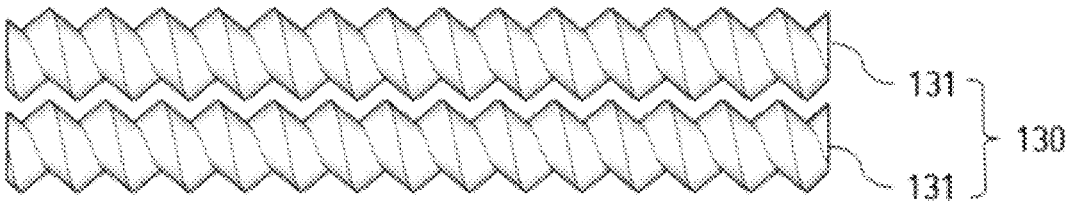
FIG. 9 is a front view showing a conveying screw of the pyrolysis gasification apparatus of the solid refuse fuel according to the first embodiment of the present disclosure.
Figure 10:
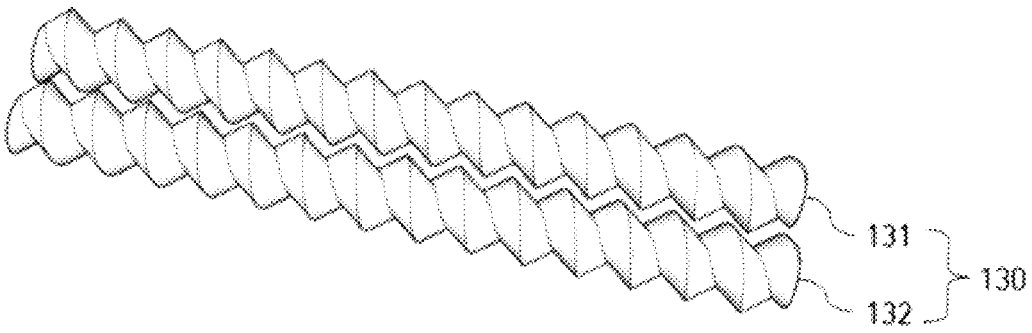
FIG. 10 is a perspective view showing the conveying screw of the pyrolysis gasification apparatus of the solid refuse fuel according to the first embodiment of the present disclosure.
Figure 11:
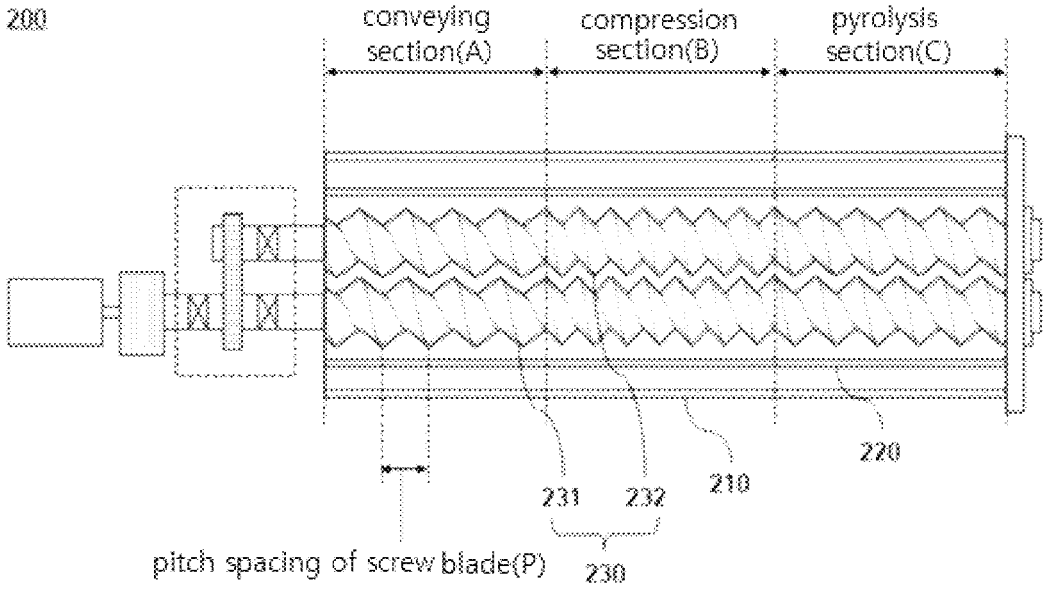
FIG. 11 is a view for explaining a pyrolysis gasification apparatus for solid refuse fuel according to a second embodiment of the present disclosure.
Figure 12:
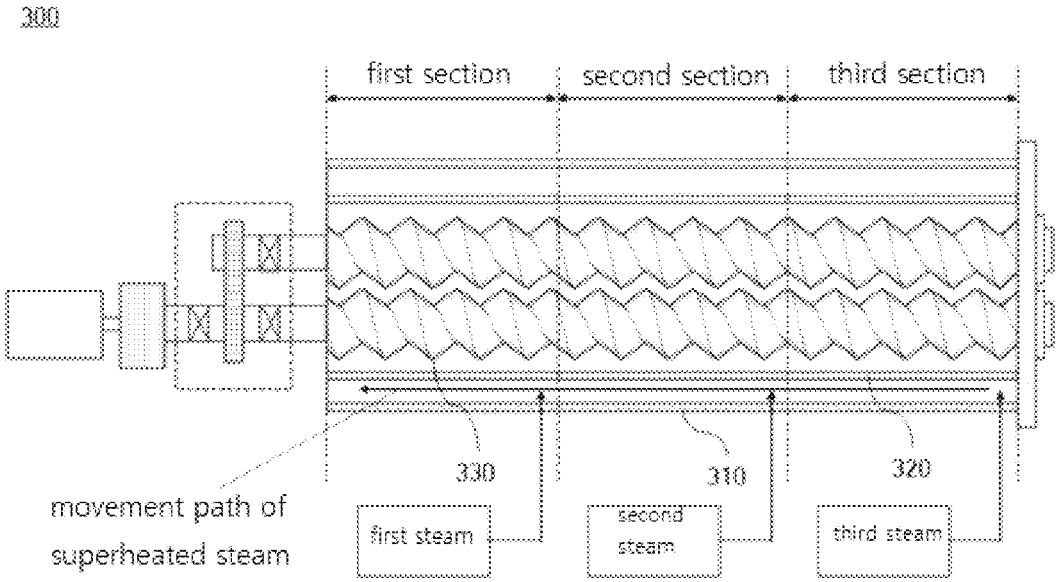
FIG. 12 is a view for explaining a pyrolysis gasification apparatus for solid refuse fuel according to a third embodiment of the present disclosure.

FIG. 1 is a view for explaining a pyrolysis gasification apparatus 100 for solid refuse fuel according to a first embodiment of the present disclosure. FIG. 2 is a cross-sectional view of the pyrolysis gasification apparatus 100 for the solid refuse fuel according to the first embodiment of the present disclosure. FIG. 3 is a perspective view of the pyrolysis gasification apparatus 100 for the solid refuse fuel according to the first embodiment of the present disclosure. FIG. 4 is a perspective view showing an internal configuration of the pyrolysis gasification apparatus 100 for the solid refuse fuel according to the first embodiment of the present disclosure. FIG. 5 is an exploded perspective view showing the internal configuration of the pyrolysis gasification apparatus 100 for the solid refuse fuel according to the first embodiment of the present disclosure. FIG. 6 is a sectional view of the pyrolysis gasification apparatus for the solid refuse fuel, in which it shows another embodiment of a screw casing in the pyrolysis gasification apparatus of the solid refuse fuel of the present disclosure. FIG. 7 is a perspective view of the pyrolysis gasification apparatus for the solid refuse fuel, in which it shows another embodiment of a screw casing in the pyrolysis gasification apparatus of the solid refuse fuel of the present disclosure. FIG. 8 is a perspective view showing a screw casing according to another embodiment of the present disclosure. FIG. 9 is a front view showing a conveying screw 130 of the pyrolysis gasification apparatus of the solid refuse fuel 100 according to the first embodiment of the present disclosure. FIG. 10 is a perspective view showing the conveying screw 130 of the pyrolysis gasification apparatus 100 for the solid refuse fuel according to the first embodiment of the present disclosure. FIG. 11 is a view for explaining a pyrolysis gasification apparatus 200 for solid refuse fuel according to a second embodiment of the present disclosure. FIG. 12 is a view for explaining a pyrolysis gasification apparatus 300 for solid refuse fuel according to a third embodiment of the present disclosure.

Referring to FIGS. 1 to 7, the pyrolysis gasification apparatus 100 of the solid refuse fuel according to the first embodiment of the present disclosure includes a superheated steam housing 110, a screw casing 120, a conveying screw 130, heat accumulators (not shown), a casing support 140, a superheated steam supplier (not shown), and a heating device (not shown).

The superheated steam housing 110 is formed in a cylindrical shape and is installed in a horizontal direction, in which superheated steam is injected into it. Here, the superheated steam housing 110 may have an opening formed at one side thereof, and the superheated steam may be supplied from the superheated steam supplier (not shown) through the opening. A gear device 20 driven by a motor device 10 may be arranged on the other side of the superheated steam housing 110.

The screw casing 120 has a tubular shape extending from one end to the other end of the superheated steam housing 110. In addition, the screw casing 120 is installed in the superheated steam housing 110 in a horizontal direction. In addition, solid refuse fuel (SRF) is introduced into the screw casing 120. Here, a space formed between an inside of the superheated steam housing 110 and an outside of the screw casing 120 may be a movement path of the superheated steam injected into the superheated steam housing 110. Here, the superheated steam moving through the movement path transfers heat to the solid refuse fuel introduced into the screw casing 120. Accordingly, the solid refuse fuel introduced into the screw casing 120 is pyrolysis gasified. Here, a baffle may be formed on the movement path to increase a residence time of the superheated steam.

In addition, the superheated steam may increase fuel capacity by adjusting a flow rate of the superheated steam injected, and may control a temperature setting more easily and efficiently.

For example, an internal temperature of a general pyrolysis gasification apparatus is maintained at about 400 degrees, but when using the superheated steam, the internal temperature may be increased to 700 degrees. Therefore, a setting range of a pyrolysis temperature may be higher than before. Further, in terms of the temperature setting, it may be easily controlled by adjusting the flow rate of the superheated steam.

The superheated steam moves through the movement path, in which the superheated steam moves in a direction opposite to a conveying direction of the solid refuse fuel.

This is because the superheated steam loses thermal energy as it travels along the movement path, gradually lowering the temperature, and thus, when the solid refuse fuel is moved in the same direction as the conveying direction of the solid refuse fuel, the temperature drops as the solid refuse fuel is conveyed.

A plurality of heat accumulators (not shown) are inserted into the movement path, in which the heat accumulator is heated by the superheated steam passing through the movement path to heat the solid refuse fuel in the screw casing 120.

In other words, the heat accumulators absorb thermal energy to maintain an internal temperature of the superheated steam housing 110 and indirectly heat the solid refuse fuel in the screw casing 120, thereby increasing the pyrolysis efficiency of the solid refuse fuel.

The heat accumulator may be in the form of a bead of a material having excellent heat transfer and durability, such as ceramic or steel, and a diameter thereof may be formed between 10 to 30 mm, preferably 20 mm in diameter. Here, naturally, the material of the heat accumulator may be various materials within the range of indirect heating of the solid refuse fuel by efficiently absorbing the thermal energy in addition to materials such as ceramic steel. In addition, the heat accumulators may be filled with a predetermined porosity in the movement path, and may have a porosity of less than about 50%.

The conveying screw 130 is provided with a plurality of screw blades on an outer peripheral surface, and is installed inside the screw casing 120 in the horizontal direction and rotates to convey the solid refuse fuel. Here, the conveying screw 130 may be connected to the gear device 20 disposed outside the superheated steam housing 110 to be rotated by the driving of the gear device 20.

Both sides of the screw blades of the conveying screw 130 may be a spatula shape, a spiral shape, a semicircular shape, a conical shape, or an elliptical shape. A cross section of the screw blades may be a triangular shape, a square shape, or a semicircular shape.

In addition, an inside of the conveying screw 130 is penetrated in a longitudinal direction, and a through passage 150 is formed therein, in which by injecting the superheated steam into the through passage 150 formed in the conveying screw 130, the solid refuse fuel in the screw casing 120 may be pyrolyzed.

A plurality of heat accumulators may be inserted into the through passage 150. The inserted heat accumulators may be filled with a predetermined porosity in the through passage 150 similarly to the heat accumulators inserted into the movement path, and may indirectly heat the solid refuse fuel in the screw casing 120.

In the embodiment, the conveying screw 130 is provided as a pair, in which the pair of conveying screws 131 and 132 is provided to be adjacent to and parallel to each other.

The pair of conveying screws 131 and 132 rotate in opposite directions to each other, in which they rotate to face inward adjacent to each other. As a result, the solid refuse fuel in the screw casing 120 may be crushed, thereby further increasing a decomposition rate of the solid refuse fuel.

In addition, an outside of the pair of conveying screw 131 and 132 is provided with the screw casing 120 surrounding outer sides of the pair of the conveying screw 131 and 132.

Referring to FIG. 5, the screw casing 120 according to the embodiment surrounds the pair of conveying screws 131 and 132, in which to surround along an outer shape of the pair of conveying screws 131 and 132, the screw casing 120 is formed in a tubular shape in which a pair of hollow pipes 120*a* and 120*b* having open sides face to each other and are welded to each other.

Here, the screw casing 120 is formed by welding the pair of pipes 120*a* and 120*b*. Therefore, the casing supports 140 are respectively provided on an upper portion and a lower portion of the screw casing 120 to prevent breakage due to external impact.

The casing support 140 may be in the form of a support plate in a longitudinal direction and have a cross-section of a "^" shape, and a plurality of holes 170 are formed at both side of the casing support 140 in the longitudinal direction.

Accordingly, the superheated steam injected into the superheated steam housing 110 may move through the plurality of holes 170, and heat transfer may also be performed in a space 160 between the casing support 140 and the screw casing 120, thereby increasing the heat transfer efficiency into the screw casing 120.

In addition, a plurality of heat accumulators may be inserted into the space 160 formed outside the screw casing 120 and inside the casing support 140, in which the heat accumulators inserted into the space 160 may also be filled in the space 160 with a predetermined porosity, and may absorb the heat of the superheated steam and indirectly heat the solid refuse fuel to more efficiently pyrolyze the solid refuse fuel.

The screw casing 120 as described above may have other types of embodiments as shown in FIGS. 6 to 8.

A screw casing 121 according to another embodiment of the present disclosure surrounds the pair of conveying screw 131, as In the form of the screw casing 120 described above with reference to FIGS. 2 to 5, in which an upper center surface 121*a* of the screw casing 121 has a straight panel shape with respect to a horizontal axis (i.e., x axis) in the center, and a lower portion thereof may be manufactured to have two rounded surfaces 121*b*, such as the screw casing 120 described above.

In this case, among the casing supports 140 provided at the upper and lower portions of the screw casing 121, the upper casing support 140 may be omitted, and it may be provided only in the lower portion of the screw casing 121, thereby enabling to manufacture easily and save cost.

The heating device (not shown) according to the present disclosure may be connected to an outlet side of the superheated steam housing 110, and may heat a discharge line of the superheated steam housing 110 to maintain a high temperature in the superheated steam housing 110.

If a temperature of the discharge line of the superheated steam housing 110 is relatively low when the solid refuse fuel is pyrolyzed, separated into vaporized fuel (hydro carbon) and residues (dust), and discharged, the vaporized fuel may be cooled and oiled.

More specifically, the pyrolysis gasification apparatus pushes and compresses the solid refuse fuel into the screw casing and gasifies it through the pyrolysis, thereby separating it into the vaporized fuel and the residue. After that, the obtained vaporized fuel is put into an SRF boiler and burned to obtain energy. Here, the superheated steam used in the pyrolysis gasification apparatus may use some of the superheated steam produced in the SRF boiler. In addition, it may be supplied using a separate superheated steam supplier as the embodiment.

Here, in the current pyrolysis gasification apparatus, residues separated and discharged through the pyrolysis are discharged as residues containing oil, not pure residues.

For example, when the refuse is introduced into an inlet side of the conventional pyrolysis gasification apparatus, the vaporized fuel discharged from an outlet side is 75%, and the residue is about 25%. Here, examination of the residue showed that there was still an oil component that is able to gasify.

Therefore, in the pyrolysis gasification apparatus of the solid refuse fuel according to the present disclosure may be provided with the heating device in the discharge line of the superheated steam housing 110 to prevent the temperature of the discharge line from lowering, thereby increasing the vaporization rate of the solid refuse fuel to increase the yield of the vaporized fuel. Further, environmental pollution may also be reduced by reducing emissions of the residue, i.e., the refuse.

As described above, the pyrolysis gasification apparatus 100 of the solid refuse fuel according to the first embodiment of the present disclosure may pyrolyze the solid refuse fuel through the injection of the superheated steam, excluding the conventional electric heater, thereby increasing the economics of the pyrolysis gasification apparatus. Further, the fuel capacity may be increased by adjusting the flow rate of the superheated steam, and a temperature setting may be easily and efficiently controlled.

In addition, it is provided with the plurality of heat accumulators in a plurality of spaces (the movement path, the through passage 150, and the space 160) through which the superheated steam in the pyrolysis gasification apparatus is moved to heat the plurality of heat accumulators by injecting the superheated steam. Therefore, it is possible to reduce the temperature deviation of the reaction temperature of the pyrolysis in the pyrolysis gasification apparatus and to maintain a high temperature through the heated plurality of heat accumulators. At the same time, it is possible to indirectly heat the solid refuse fuel to increase the overall thermal efficiency of the apparatus.

Further, the heating device is provided on the outlet side of the superheated steam housing 110 to prevent the vaporized fuel obtained through the pyrolysis of the solid refuse fuel from cooling and oiling. Therefore, it is possible to increase the yield of the vaporized fuel and reduce the amount of the residues discharged.

In addition, according to another embodiment of the present disclosure, the pyrolysis gasification apparatus 100 of the solid refuse fuel may include an electric heater (not shown) for preventing heat loss of the superheated steam in at least a portion of the outside of the superheated steam housing 110.

Hereinafter, the pyrolysis gasification apparatus 200 for the solid refuse fuel according to the second embodiment of the present disclosure will be described.

Referring to FIG. 11, the pyrolysis gasification apparatus 200 for the solid refuse fuel according to the second embodiment of the present disclosure has the same basic configuration as the pyrolysis apparatus 100 for the solid refuse fuel according to the first embodiment as described above.

However, in the embodiment, a conveying screw 230 is divided into a conveying section A, a compression section B, and a pyrolysis section C, and a pitch spacing P of screw blades of the conveying screw 230 is different for each divided section.

In other words, the solid refuse fuel introduced into a screw casing 220 is pyrolyzed by the superheated steam injected into a superheated steam housing 210, and is conveyed by the conveying screw 230. In this process, the solid refuse fuel is separated and discharged to the outside during a process of conveying, compression, and pyrolysis treatment.

In the embodiment, the conveying screw is divided into the conveying section A, the compression section B, and the pyrolysis section C for each treatment section, and the pitch spacing P of the screw blades of the conveying screw 230 for each treatment section is optimized for the process. Therefore, the decomposition rate of the solid refuse fuel may be increased.

In other words, the conveying section A is a section in which the temperature of the superheated steam is the lowest in consideration of a moving direction of the superheated steam, and corresponds to a process of preheating the solid refuse fuel.

The compression section B is a section for increasing gas pressure applied to the solid refuse fuel.

The pyrolysis section C is a pyrolysis section of the solid refuse, which is separated and discharged into the vaporized fuel (hydrocarbon) and the residues (dust) at the end of the section.

In order to increase the pressure applied to the solid refuse fuel in the compression section B, the pitch spacing of the screw blades in the compression section B is made the smallest.

In addition, the pitch spacing P of the screw blades of the conveying section A and the pyrolysis section C may be the same, or the pitch spacing P of the screw blades of the pyrolysis section C may be formed larger than the pitch spacing P of the screw blades of the conveying section A. Preferably, the pitch spacing P of the screw blades of the pyrolysis section C may be formed larger than the pitch spacing P of the screw blades of the conveying section A.

As such, the pyrolysis gasification apparatus 200 of the solid refuse fuel according to the second embodiment of the present disclosure divides the conveying screw 230 for conveying the solid refuse fuel into the transfer, compression, and pyrolysis section, in which the pitch spacing of the screw blades is provided to be variable so as to be different for each section. Therefore, the solid refuse fuel conveyed by the conveying screw 230 may be preheated, pyrolyzed, and separated more efficiently.

Also, according to another embodiment of the present disclosure, the pyrolysis apparatus 200 for the solid refuse fuel may further include a vaporized fuel conveying line (not shown) for conveying the vaporized fuel discharged from the pyrolysis section C to another apparatus. The vaporized fuel conveying line may be a coaxial double tube. Here, the vaporized fuel moves through an inner tube of the double tube. In addition, the superheated steam may be supplied to a space formed between an outside of the inner tube and an inside of the outer tube of the double tube. Here, the supplied superheated steam functions to prevent liquefaction due to heat loss in a process of moving the vaporized fuel.

In addition, according to another embodiment of the present disclosure, the pyrolysis apparatus 200 for the solid refuse fuel may include a superheated steam barrier film (not shown) formed in a predetermined region of the conveying section A to allow the superheated steam to be transferred only to a partial section of the conveying section A.

Hereinafter, the pyrolysis gasification apparatus 300 for the solid refuse fuel according to the third embodiment of the present disclosure will be described.

Referring to FIG. 12, the pyrolysis gasification apparatus 300 for the solid refuse fuel according to the third embodiment of the present disclosure has the same basic configuration as the pyrolysis apparatuses 100 and 200 for the solid refuse fuel according to the first and second embodiment as described above.

However, in the embodiment, a movement path in which the superheated steam moves in a superheated steam housing 310 is divided into a plurality of sections, and each section is supplied with the superheated steam at different temperatures.

In other words, instead of injecting the superheated steam into the superheated steam housing 310 at once, the movement path of the superheated steam is divided into the plurality of sections, that is, a first section according to the preheating process of the solid refuse fuel, a second section according to the pyrolysis process, and a third section according to the separation process, and a first superheated steam, a second superheated steam, and a third superheated steam, which are set according to the process, are individually supplied to each section. Therefore, it is possible to increase the pyrolysis gasification efficiency of the solid refuse fuel.

Here, the temperature of the superheated steam supplied to each section is set to decrease gradually along a movement path direction of the superheated steam. In the embodiment, the appropriate superheated steam is injected in the order of the third superheated steam>the second superheated steam>the first superheated steam.

As such, the pyrolysis gasification apparatus 300 of the solid refuse fuel according to the third embodiment of the present disclosure divides a path through which the superheated steam moves into the plurality of sections, and individually supplies the superheated steam having different temperatures for each section. Therefore, the solid refuse fuels may be pyrolyzed and gasified more effectively. Furthermore, the high-efficiency pyrolysis gasification treatment of the solid refuse fuel may increase the yield of vaporized fuel and reduce residue discharges. Therefore, there is also the effect of reducing the environmental problems of the solid refuse disposal.

Various embodiments of the invention described above are disclosed for purposes of illustration. Those skilled in the art having ordinary knowledge of the present disclosure may make various modifications, changes, and additions within the spirit and scope of the present disclosure. Such modifications, changes, and additions should be considered to be within the scope of the following claims.

REFERENCE NUMERAL

100, 200, 300: pyrolysis gasification apparatus for solid refuse fuel

110, 210, 310: superheated steam housing

120, 220, 320: screw casing

130, 230, 330: conveying screw

140: casing support

150: through passage

160: space

170: hole

What is claimed is:

1. A pyrolysis gasification apparatus for solid refuse fuel (SRF), comprising:

a superheated steam housing formed in a cylindrical shape and installed in a horizontal direction, wherein superheated steam is injected into the superheated steam housing;

a screw casing formed in a tubular shape extending from one end to the other end inside the superheated steam housing and installed in the horizontal direction inside the superheated steam housing, wherein the solid refuse fuel is introduced into the screw casing;

a conveying screw with a plurality of screw blades on an outer peripheral surface thereof, the conveying screw being installed inside the screw casing in the horizontal direction and rotating to convey the solid refuse fuel; and a superheated steam supplier for supplying the superheated steam into the superheated steam housing, wherein the superheated steam moves through a movement path formed between an inside of the superheated steam housing and an outside of the screw casing, wherein a plurality of heat accumulators are inserted into the movement path, wherein the heat accumulators are in the form of a bead of material having excellent heat transfer and durability and have a diameter of 10 to 30 mm.

2. The apparatus of claim 1, wherein an inside of the conveying screw has a form penetrated in a longitudinal direction, and the superheated steam moves through a through passage formed in the inside of the conveying screw.

3. The apparatus of claim 2, wherein a plurality of heat accumulators are inserted into the through passage of the conveying screw.

4. The apparatus of claim 1, wherein the conveying screw is made in a pair, and a pair of conveying screws may be provided to be adjacent to and parallel to each other, and wherein the screw casing is in the form of a tubular shape coupled by welding a pair of hollow pipes having open sides to face each other, thereby being formed to surround an outer side of the pair of conveying screws.

5. The apparatus of claim 4, wherein a lower portion and an upper portion of the screw casing are provided with a casing support for supporting the pair of hollow pipes with the open sides.

6. The apparatus of claim 1, wherein the conveying screw is made in a pair, and a pair of conveying screws are provided to be adjacent to and parallel to each other, and wherein the screw casing is formed to surround an outer side of the pair of conveying screws, wherein a middle surface of an upper portion thereof is a straight panel shape and a lower portion thereof has two rounded faces to surround along an outer circumferential surface of a lower portion of the pair of conveying screws.

7. The apparatus of claim 6, wherein the lower portion of the screw casing is provided with a casing support for supporting coupling of the two rounded surfaces.

8. The apparatus of claim 4, wherein the pair of conveying screws is rotated in opposite directions to each other, and is rotated to face inward adjacent to each other.

9. The apparatus of claim 5, wherein a cross section of the casing support is in the form of a support plate in a longitudinal direction having a "^" shape, and a plurality of holes are formed on both sides thereof in the longitudinal direction, wherein the superheated steam moves through the plurality of holes.

10. The apparatus of claim 9, wherein a plurality of heat accumulators are inserted into a space formed inside the casing support.

11. The apparatus of claim 1, wherein conveying directions of the superheated steam and the solid refuse fuel are opposite to each other.

12. The apparatus of claim 1, wherein both sides of the screw blades of the conveying screw are any one of a spatula shape, a spiral shape, a semicircular shape, a conical shape, and an elliptical shape.

13. The apparatus of claim 1, wherein an outlet side of the superheated steam housing is provided with a heating device, thereby maintaining a high temperature in the superheated steam housing.

14. The apparatus of claim 1, wherein the conveying screw is divided into a conveying section A, a compression section B, and a pyrolysis section C, wherein a pitch spacing of the screw blades of the conveying screw for each divided section differs from each other.

15. The apparatus of claim 14, wherein the pitch spacing of the screw blades of the compression section B of the conveying screw is formed the smallest.

16. The apparatus of claim 15, wherein the pitch spacings of the screw blades of the conveying section A and the pyrolysis section C of the conveying screw are formed the same, or the pitch spacings of the screw blades of the pyrolysis section C is able to be formed larger than the pitch spacings of the screw blades of the conveying section A.

17. The apparatus of claim 1, wherein the movement path through which the superheated steam moves is divided into a first section, a second section, and a third section, wherein the superheated steam having a different temperature is individually supplied to each divided section.

18. The apparatus of claim 17, wherein a temperature of the superheated steam supplied to each section is controlled by adjusting a flow rate of the superheated steam depending on a reaction temperature of pyrolysis of the solid refuse fuel.

* * * * *